US005874207A

United States Patent [19]

Oyagi et al.

[11] Patent Number: 5,874,207

[45] Date of Patent: Feb. 23, 1999

[54] PRE-FOGGED DIRECT-POSITIVE SILVER HALIDE PHOTOGRAPHIC LIGHT-SENSITIVE MATERIAL AND METHOD OF PREPARING EMULSION FOR THE SAME

[75] Inventors: Isao Oyagi; Shingo Nishiyama; Nobuaki Inoue, all of Kanagawa, Japan

[73] Assignee: Fuji Photo Film Co., Ltd., Kanagawa, Japan

[21] Appl. No.: 857,821

[22] Filed: May 16, 1997

[30] Foreign Application Priority Data

May 20, 1996 [JP] Japan ..... 8-125067

[51] Int. Cl.[6] ..... G03C 1/485; G03C 1/10; G03C 1/34

[52] U.S. Cl. ..... 430/596; 430/597; 430/598; 430/600; 430/601; 430/610; 430/613

[58] Field of Search ..... 430/596, 597, 430/598, 601, 610, 600, 613

[56] References Cited

U.S. PATENT DOCUMENTS

| | | | |
|---|---|---|---|
| 4,115,122 | 9/1978 | Adachi et al. | 430/596 |
| 4,699,873 | 10/1987 | Takahashi et al. | 430/446 |
| 4,828,973 | 5/1989 | Hirano et al. | 430/598 |
| 4,929,535 | 5/1990 | Takahashi et al. | 430/264 |
| 4,983,508 | 1/1991 | Ishiguro et al. | 430/569 |
| 5,030,553 | 7/1991 | Kuwashima et al. | 430/598 |
| 5,035,993 | 7/1991 | Hirano et al. | 430/598 |
| 5,382,496 | 1/1995 | Sakai et al. | 430/264 |
| 5,432,052 | 7/1995 | Ohshima | 430/567 |
| 5,478,697 | 12/1995 | Sakai et al. | 430/264 |

OTHER PUBLICATIONS

James, T. H., "The Theory of the Photographic Process", 4th ed., Macmillan, New York, pp. 185–187, 1977.

*Primary Examiner*—Mark F. Huff
*Attorney, Agent, or Firm*—Sughrue, Mion, Zinn, Macpeak & Seas, PLLC

[57] ABSTRACT

A direct-positive silver halide light-sensitive material comprising a support having thereon at least one pre-fogged light-sensitive silver halide emulsion layer, wherein the light-sensitive material comprises a specific onium salt compound in the emulsion layer or a hydrophilic protective colloid layer adjacent thereto. Also disclosed is a method of preparing a pre-fogged light-sensitive silver halide emulsion for use in the light-sensitive material.

5 Claims, No Drawings

PRE-FOGGED DIRECT-POSITIVE SILVER HALIDE PHOTOGRAPHIC LIGHT-SENSITIVE MATERIAL AND METHOD OF PREPARING EMULSION FOR THE SAME

FIELD OF THE INVENTION

The present invention relates to a method of preparing a pre-fogged direct-positive silver halide emulsion and a light-sensitive material using the emulsion. More specifically, the invention relates to a direct reversal emulsion having high sensitivity and excellent storability in a refrigerator and to a direct-positive silver halide photographic light-sensitive material having improved shelf life.

BACKGROUND OF THE INVENTION

There are known direct-positive light-sensitive materials which provides a positive image by being exposed a pre-fogged silver halide to destroy the fog nuclei. The direct-positive light-sensitive materials of such a type include high-sensitive photographic materials for photograph-taking use, wherein desensitizing dyes are utilized, as described in JP-B-50-3938 (The term "JP-B" as used herein means an "examined Japanese patent publication") and JP-B-50-3937 and photographic materials suitable for processing in illuminated room as described in JP-A-62-234156 (The term "JP-A" as used herein means an "unexamined published Japanese patent application") and JP-A-61-251843.

Hitherto, the fogging of direct-positive light-sensitive materials have been carried out by using a reducing agent after grain formation so as to form reduced Ag nuclei on the grain surfaces to the extent that the resulting fog is photobleachable. In order to achieve high-sensitivity and hard-contrast properties, the extent of fogging is required to be controlled and to be rendered uniform among the grains. However, heightening the sensitivity by reducing the fogging extent is accompanied with problems of making it difficult to provide the intended Dmax and of rendering the gradation soft.

Also, controlling the fogging extent in order to lower the Dmin provides a disadvantage in failing to produce sufficient Dmax and rendering the gradation soft.

Further, direct-positive light-sensitive materials for photograph-taking use are required to have high sensitivity. Therefore, the extent of fogging with a reducing agent should not be enhanced, rendering the Ag nuclei formed minute. Thus, the sensitivity and Dmax of such a raw emulsion tend to vary during the storage in a refrigerator. Even after the emulsion-preparation is completed by adding various additives to such a raw emulsion and a light-sensitive material is produced by coating the completed emulsion on a support, the light-sensitive material thus produced suffers from the defect that it shows variation in sensitivity and Dmax depending upon storage conditions, and so it is inferior in stability, as compared to other general light-sensitive materials.

With respect to direct-positive light-sensitive materials suitable for illuminated room processing, on the other hand, it is necessary to lower their sensitivity, and therefore, the extent of fogging with a reducing agent must be enhanced. This arise a problem that the Ag nuclei formed are hard to be bleached by exposure, and the Dmin thereof is increased.

To solve these problems, the use of a gold compound has been proposed in JP-B-50-3978. However, even when the gold compound is used, the stability of the resulting Ag nuclei is insufficient and the Dmin thereof tends to elevate.

With respect to a development processing, the direct-positive light-sensitive materials have so far been subjected to lith development (using a lith developer, e.g., HS-5, commercial name, a product of Fuji Photo Film Co., Ltd.), but in recent years the trend of processing systems has changed. Specifically, direct-positive light-sensitive materials required to have suitability for rapid processing, such as RAS (which stands for rapid access) processing and hybrid processing (using, e.g., Grandex, produced by Fuji Photo Film Co., Ltd. or Ultratech, produced by Eastman Kodak Co.), as a result, the rapid processing have been desired to provide a high Dmax, a low Dmin, a high contrast, etc. each at the level of the lith processing. With the intention to meet these various requirements, the method of not only providing high sensitivity, high Dmax and high contrast but also ensuring satisfactory stability upon storage in a refrigerator is disclosed, e.g., in JP-A-05-289213. However, since such a method is intended to achieve its aim by first forming stable fogged silver nuclei and then bleaching them, thereby rendering the silver nuclei further minute, it encounters a problem of the storage instability of minute silver nuclei. Thus, it has been strongly desired to develop further advanced arts of stabilizing minute fogged silver nuclei.

SUMMARY OF THE INVENTION

Therefore, an object of the present invention is to provide a method of preparing a pre-fogged direct-positive silver halide emulsion which enables the preparation of a raw emulsion having excellent storability in a refrigerator and satisfactory shelf life without imparting photographic properties, such as sensitivity, Dmax, Dmin and toe gradation.

Another object of the present invention is to provide a light-sensitive material comprising the pre-fogged direct-positive silver halide emulsion.

Other objects and effects of the present invention will be apparent from the following description.

The above-described objects of the present invention have been achieved by providing:

(1) a direct-positive silver halide photographic light-sensitive material which comprises a support having thereon at least one pre-fogged light-sensitive silver halide emulsion layer, wherein the light-sensitive material contains at least one compound represented by the following formula (A), (B-1), (B-2) or (B-3) in the emulsion layer or a hydrophilic protective colloid layer adjacent to the emulsion layer;

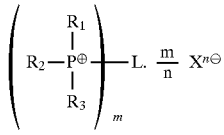

(A)

wherein $R_1$, $R_2$ and $R_3$ each represents an unsubstituted or substituted alkyl, cycloalkyl, aryl, alkenyl, cycloalkenyl or heterocyclic group, m represents an integer, L represents an m-valent organic group which is attached to the P atom via its carbon atom, n represents an integer of 1, 2 or 3, and X is an n-valent anion which may be attached to L;

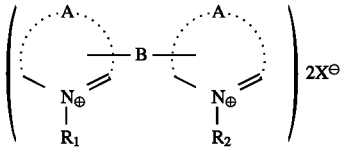

(B-1)

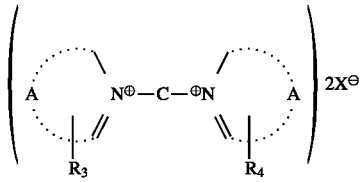

(B-2)

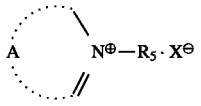

(B-3)

wherein A represents an organic group for completing a heterocyclic ring, B and C each represents a divalent group, $R_1$ and $R_2$ each represents an alkyl group or an aryl group, $R_3$ and $R_4$ each represents a hydrogen atom or a substituent group, $R_5$ represents an alkyl group, and X represents an anion or becomes unnecessary when an inner salt is formed; and (2) a method of preparing a pre-fogged direct-positive silver halide emulsion which comprises a step of:
   (a) forming silver halide grains; and
   (b) fogging the grain surface with a reducing agent to produce silver nuclei, wherein at least one compound represented by the above described formula (A), (B-1), (B-2) or (B-3) is used.

In an embodiment of the above described preparation method, the grain surface is fogged in the presence of the at least one compound represented by formula (A), (B-1), (B-2) or (B-3) to produce silver nuclei.

Another embodiment of the above described preparation method, further comprising (c) storing the emulsion in a refrigerator, wherein the at least one compound represented by formula (A), (B-1), (B-2) or (B-3) is added to the emulsion after the fogging and before the storing.

In still another embodiment of the above described preparation method, the at least one compound represented by formula (A), (B-1), (B-2) or (B-3) is added to the emulsion immediately before coating the emulsion to prepare a silver halide photographic light-sensitive material.

DETAILED DESCRIPTION OF THE INVENTION

The formula (A) is described in detail below.

In formula (A), $R_1$, $R_2$ and $R_3$ each represents an alkyl group, a cycloalkyl group, an aryl group, an alkenyl group, a cycloalkenyl group or a heterocyclic group. Each of these groups may have one or more substituents.

m represents an integer, L represents an m-valent organic group which is attached to the P atom via its carbon atom, n is an integer from 1 to 3, and X represents an n-valent anion. L and X may be in the state of dissociation or coupling with each other.

The formula (A) is described in more detail below.

Examples of a group represented by each of $R_1$, $R_2$ and $R_3$ include straight-chain or branched alkyl groups such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group and an octadecyl group; aralkyl groups such as substituted and unsubstituted benzyl groups; cycloalkyl groups such as a cyclopropyl group, a cyclopentyl group and a cyclohexyl group; aryl groups such as a phenyl group, a naphthyl group and a phenanthryl group; alkenyl groups such as an allyl group, a vinyl group and 5-hexenyl group; cycloalkenyl groups such as a cyclopentenyl group and a cyclohexenyl group; and heterocyclic groups such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group and a pyrrolidyl group. Examples of substituents which can be present on those groups include halogen atoms such as fluorine, chlorine, bromine and iodine atoms, a nitro group, primary, secondary and tertiary amino groups, an alkyl- or aryl-ether group, an alkyl- or aryl-thioether group, a carbonamido group, a carbamoyl group, a sulfonamido group, a sulfamoyl group, a hydroxyl group, a sulfoxy group, a sulfonyl group, a carboxyl group, a sulfonic acid group, a cyano group and a carbonyl group, in addition to the groups represented by $R_1$, $R_2$ and $R_3$.

Specific examples of a group represented by L include polymethylene groups such as trimethylene, tetramethylene, hexamethylene, pentamethylene, octamethylene and dodecamethylene groups, divalent aromatic groups such as phenylene, biphenylene and naphthylene groups, polyvalent aliphatic groups such as trimethylenemethyl and tetramethylenemethyl groups, and polyvalent aromatic groups such as phenylene-1,3,5-toluyl and phenylene-1,2,4,5-tetrayl groups, in addition to the groups having the same meanings as $R_1$, $R_2$ and $R_3$.

Specific examples of an anion represented by X include halogen ions such as chlorine, bromine and iodine ions, carboxylate ions such as acetate, oxalate, fumarate and benzoate ions, sulfonate ions such as p-toluenesulfonate, methanesulfonate, butanesulfonate and benzenesulfonate ions, a sulfate ion, a perchlorate ion, a carbonate ion and a nitrate ion.

In formula (A), $R_1$, $R_2$ and $R_3$ each is preferably a group containing not more than 20 carbon atoms. In particular, aryl groups containing not more than 15 carbon atoms are preferred. The integer represented by m is preferably 1 or 2. When m is 1, L is preferably a group containing not more than 20 carbon atoms, particularly preferably, an alkyl or aryl group containing not more than 20 carbon atoms. When m is 2, the divalent organic group represented by L is preferably an alkylene group, an arylene group, a divalent group formed by combining these groups, or a divalent group formed by combining alkylene or/and arylene groups with at least one group selected from among —CO—, —O—, —$NR_4$— (wherein $R_4$ represents a hydrogen atom or a group having the same meaning as $R_1$, $R_2$ and $R_3$, and if two or more $R_4$ groups are present in the molecule they may represent the same group or different groups and further may combine with each other), —S—, —SO— and —SO2— groups. When m is 2, L is particularly preferably a divalent group which has not more than 20 carbon atoms in total and links with the P atom via its carbon atom. When m is an integer of not less than 2, two or more $R_1$ groups, two or more $R_2$ groups and two or more $R_3$ groups are present in the molecule. In such a case, the plural $R_1$, $R_2$ and $R_3$ groups may be the same or different from one another.

Preferably, n is 1 or 2, and m is 1 or 2. X may form an inner salt by combining with $R_1$, $R_2$, $R_3$ or L.

Many of the compounds represented by formula (A) for use in the present invention are known compounds, and some of them are available as reagents. In general, these compounds can be synthesized using a method of reacting a phosphinic acid with an alkylation agent such as an alkyl halide or a sulfonic acid ester, or a method of exchanging the counter anion of a phosphonium salt in a conventional manner.

Specific examples of a compound represented by formula (A) are shown below, but the present invention should not be construed as being limited to these examples.

A-1

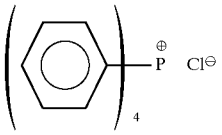

A-2

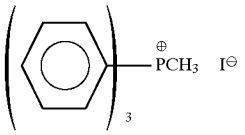

A-3

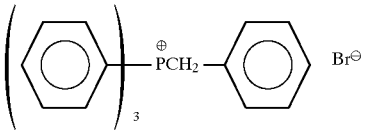

A-4

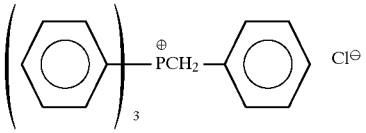

A-5

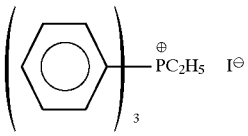

A-6

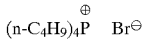

A-7

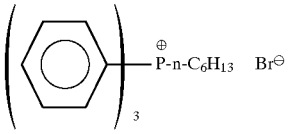

A-8

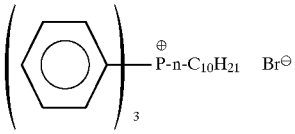

A-9

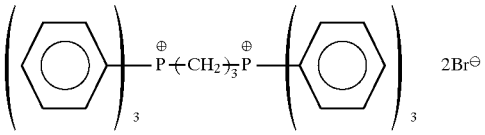

A-10

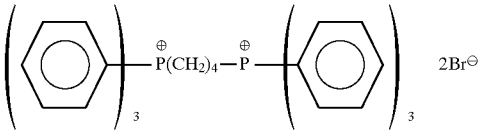

A-11

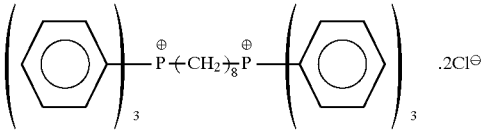

-continued
A-12
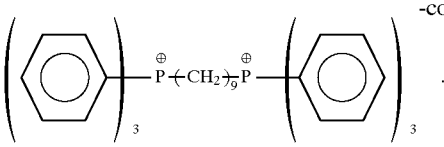
A-13
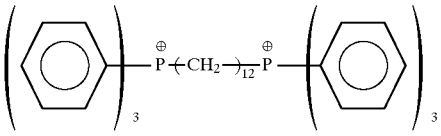
A-14
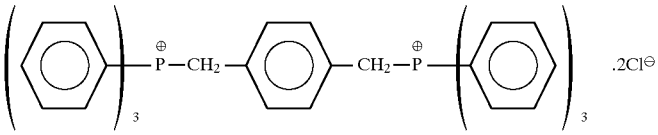
A-15
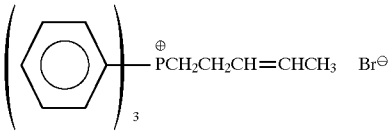
A-16
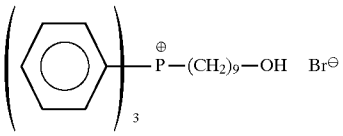
A-17
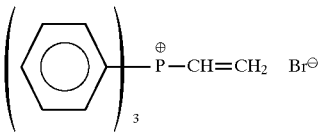
A-18
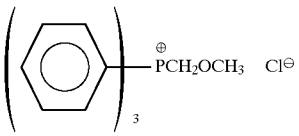
A-19
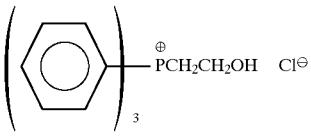
A-20
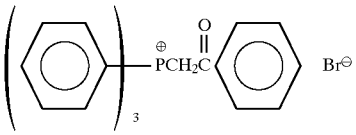
A-21
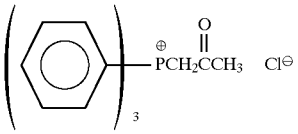
A-22
$(n\text{-}C_4H_9)_3\overset{\oplus}{P}CH_2CH_2OH \quad Br^{\ominus}$
A-23
$(n\text{-}C_4H_9)_3\overset{\oplus}{P}C_2H_5.\ \frac{1}{2}.SO_4^{2\ominus}$
A-24
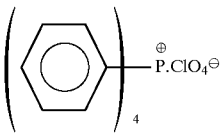
A-25
$Ph_3\overset{\oplus}{P}-(CH_2)_4COOH \quad Br^{\ominus}$ -continued
A-26
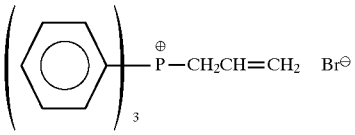
A-27
$(n\text{-}C_4H_9)_3\overset{\oplus}{P}\text{-}n\text{-}C_{16}H_{33}\quad Br^{\ominus}$
A-28
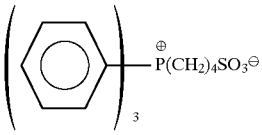
A-29
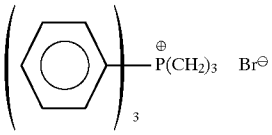
A-30
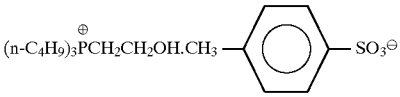
A-31
$(n\text{-}C_4H_9)_3\overset{\oplus}{P}CH_3I^{\ominus}$
A-32
$(HOCH_2)_3\overset{\oplus}{P}CH_3I^{\ominus}$
A-33
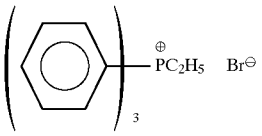
A-34
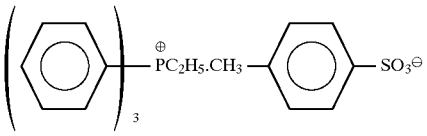
A-35
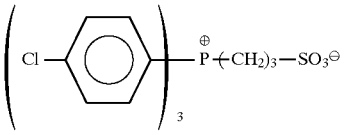
A-36
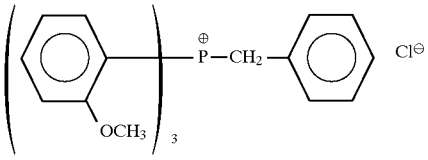
A-37
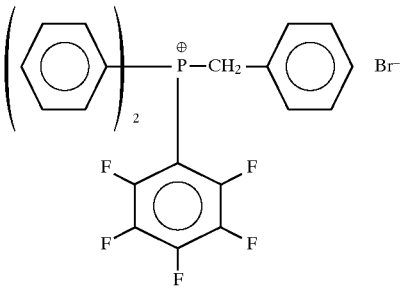
A-38
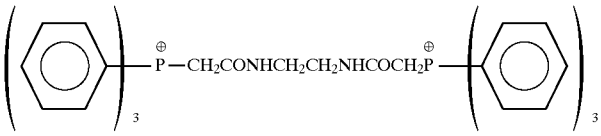

-continued
A-39
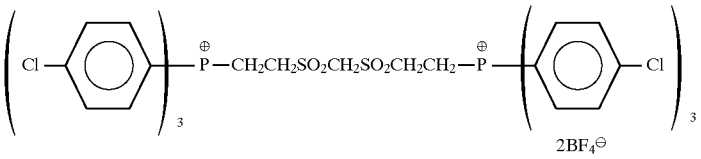
A-40
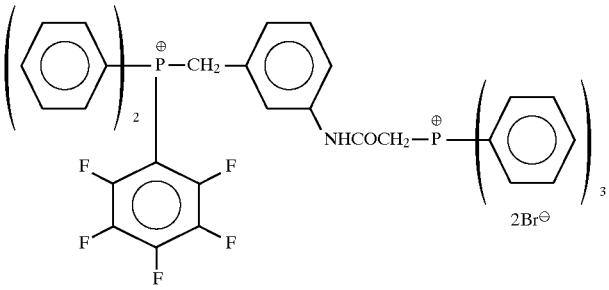
A-41
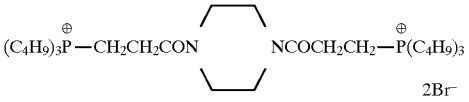
A-42
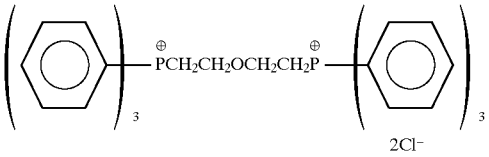
A-43
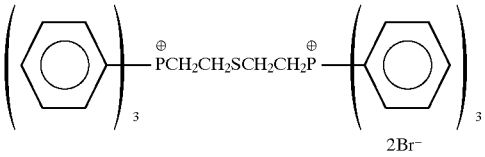
A-44
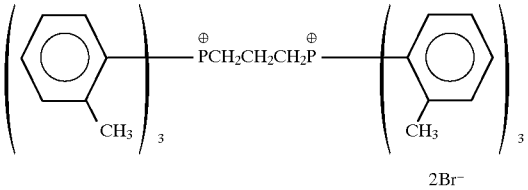
A-45
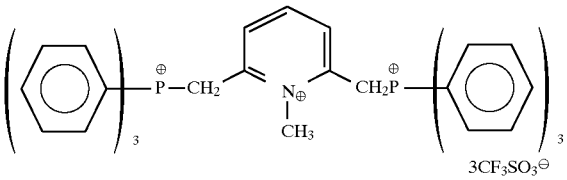
A-46
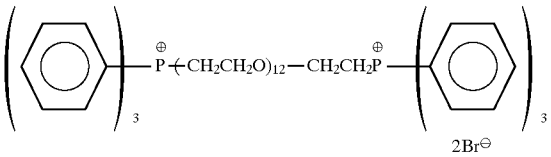
A-47
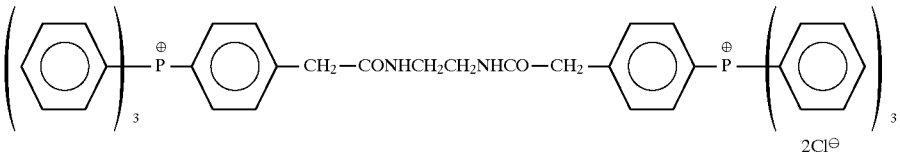

The addition amount of the compound of formula (A) for use in the present invention is not particularly limited, but it is preferably from $2\times10^{-5}$ to $5\times10^{-2}$ mol per mol of silver halide, particularly preferably from $5\times10^{-5}$ to $1\times10^{-2}$ mol per mol of silver halide.

Then, the formulae (B-1), (B-2) and (B-3) are described below.

In each of formulae (B-1), (B-2) and (B-3), A represents an organic group completing a heterocyclic ring. B and C each represents a divalent group. $R_1$ and $R_2$ each represents an alkyl or aryl group. $R_3$ and $R_4$ each represents a hydrogen atom or a substituent group. $R_5$ represents an alkyl group. X represents an anion, but becomes unnecessary when an inner salt is formed.

More detailed description for those formulae are given below.

The organic group completing a heterocyclic ring, which is represented by A in each formulae, may contain carbon, hydrogen, oxygen, nitrogen and sulfur atoms, and further may be condensed with a benzene ring. The heterocyclic ring completed by A is preferably a 5- or 6-membered ring. In particular, preferred examples thereof include a pyridine ring, a quinoline ring and an isoquinoline ring. The organic group represented by A may have a substituent. Preferred examples of the substituent include halogen atoms (e.g., chlorine, bromine), substituted or unsubstituted alkyl groups (e.g., methyl, hydroxyethyl), substituted or unsubstituted aralkyl groups (e.g., benzyl, p-methoxyphenetyl), substituted or unsubstituted aryl groups (e.g., phenyl, tolyl, p-chlorophenyl, furyl, thienyl, naphthyl), substituted or unsubstituted acyl groups (e.g., benzoyl, p-bromobenzoyl, acetyl), a sulfo group, a carboxyl group, a hydroxy group, alkoxy groups (e.g., methoxy, ethoxy), an aryloxy group, an amido group, a sulfamoyl group, a carbamoyl group, a ureido group, unsubstituted or alkyl-substituted amino groups, a cyano group, a nitro group, an alkylthio group and an arylthio group. Of these substituents, an aryl group, a sulfo group, a carboxyl group and a hydroxy group are particularly preferred.

The divalent groups represented by B and C each is preferably an alkylene group, an arylene group, an alkenylene group, —$SO_2$—, —SO—, —O—, —S—, —N($R_6$)— or a combination of two or more of these groups. $R_6$ represents an alkyl group, an aryl group or a hydrogen atom. Particularly preferred examples of B and C include an alkylene group, an arylene group, —O—, —S— and combinations of two or more thereof.

$R_1$ and $R_2$ may be the same or different, and each is preferably an alkyl group having 1 to 20 carbon atoms. The alkyl group may have a substituent. Examples of the substituent include halogen atoms (e.g., chlorine, bromine), substituted or unsubstituted aryl groups (e.g., phenyl, tolyl, p-chlorophenyl, furyl, thienyl, naphthyl), substituted or unsubstituted acyl groups (e.g., benzoyl, p-bromobenzoyl, acetyl), a sulfo group, a carboxyl group, a hydroxy group, alkoxy groups (e.g., methoxy, ethoxy), an aryloxy group, an amido group, a sulfamoyl group, a carbamoyl group, a ureido group, unsubstituted or alkyl-substituted amino groups, a cyano group, a nitro group, an alkylthio group and an arylthio group. In particular, $R_1$ and $R_2$ each is preferably an alkyl group having 1 to 10 carbon atoms. Preferred examples of the substituent include an aryl group, a sulfo group, a carboxyl group and a hydroxy group.

$R_3$ and $R_4$ each represents a hydrogen atom or a substituent group. Examples of the substituent group represented by $R_3$ or $R_4$ include the groups recited above as the substituent on the alkyl group represented by $R_1$ or $R_2$. $R_3$ and $R_4$ each preferably has 0 to 10 carbon atoms. Specifically, preferred examples of the substituent group represented by $R_3$ or $R_4$ include aryl-substituted alkyl groups and substituted or unsubstituted aryl groups.

$R_5$ is preferably an alkyl group having 1 to 20 carbon atoms. The alkyl group represented by $R_5$ may be any of straight-chain, branched and cyclic forms, and may have a substituent. Examples of the substituent include the groups recited above as the substituent on the alkyl group represented by $R_1$ or $R_2$.

X represents an anion, but it is unnecessary when the compound forms an inner salt. Examples of X include chlorine ion, bromine ion, iodine ion, nitrate ion, sulfate ion, p-toluenesulfonate ion and oxalate ion.

The compounds represented by formulae (B-1), (B-2) and (B-3), respectively, for use in the present invention can be readily synthesized in accordance with well-known methods. For instance, the syntheses thereof can be effected by reference to *Quart. Rev.,* 16, 163 (1962).

Specific examples of compounds represented by formulae (B-1), (B-2) and (B-3), respectively, are shown below. However, the present invention should not be construed as being limited to the following compounds.

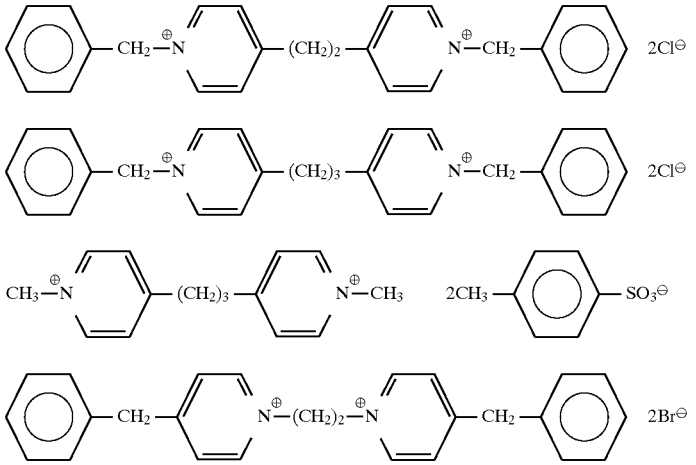

B-1

B-2

B-3

B-4

-continued
B-5
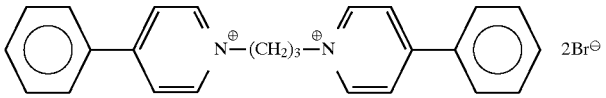
B-6
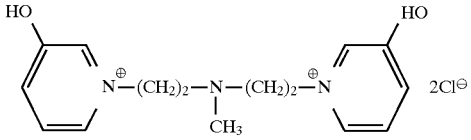
B-7
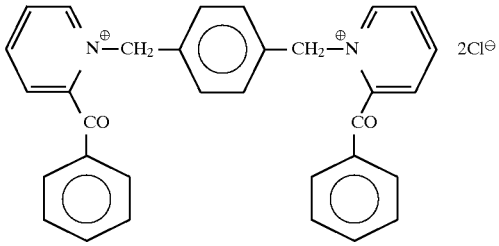
B-8
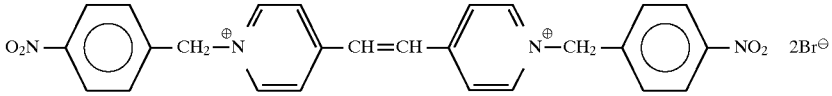
B-9
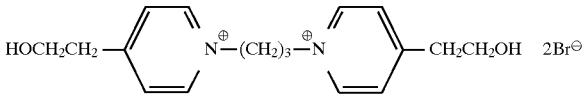
B-10
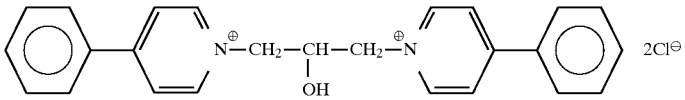
B-11
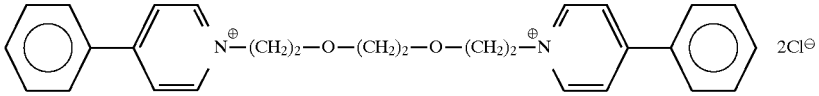
B-12
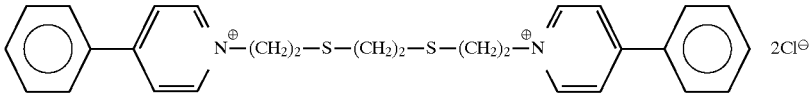
B-13
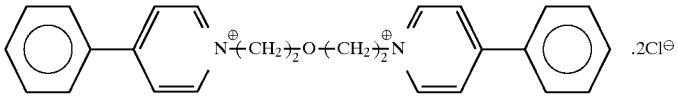
B-14
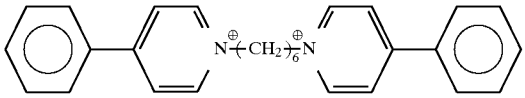
B-15
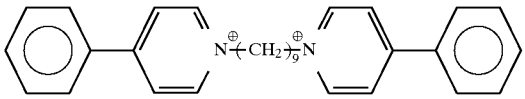
B-16
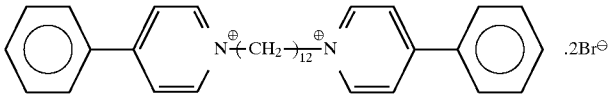

-continued
B-17
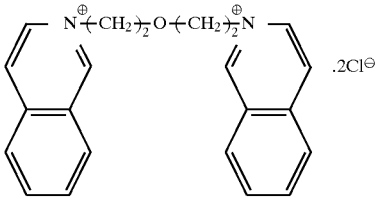
.2Cl⊖
B-18
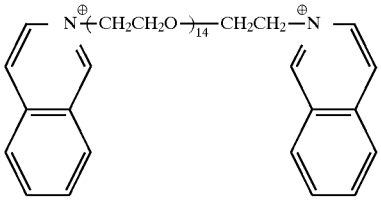
.2Br⊖
B-19
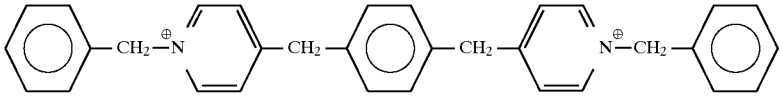
.2Cl⊖
B-20
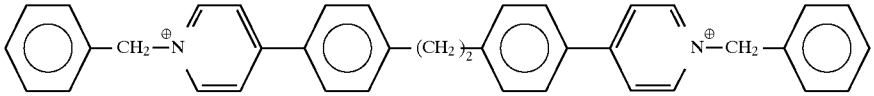
.2Cl⊖
B-21
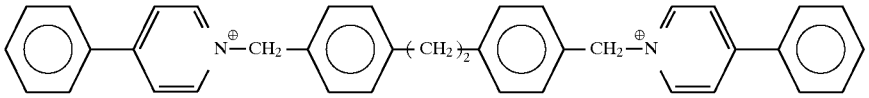
.2Cl⊖
B-22
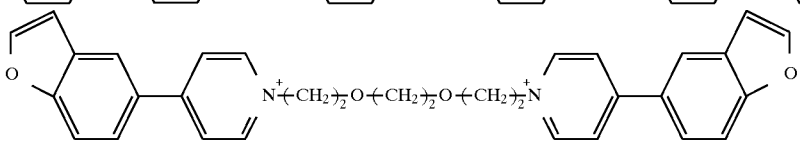
.2Cl⁻
B-23
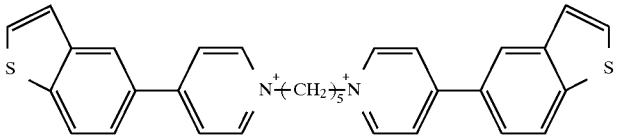
.2Br⁻
B-24
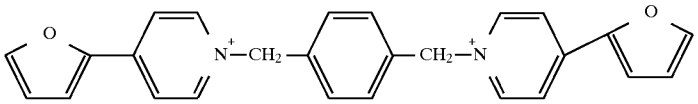
.2Cl⁻
B-25
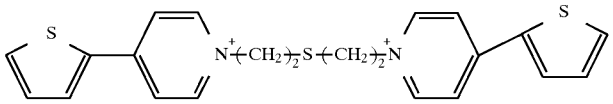
.2Cl⁻
B-26
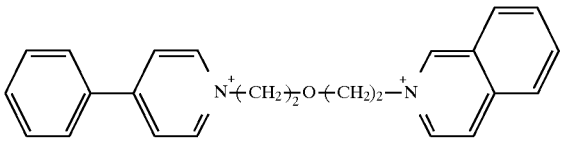
.2Cl⁻
B-27
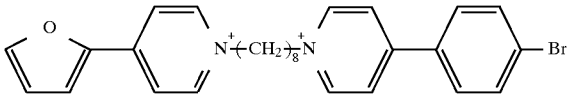
.2Cl⁻
B-28
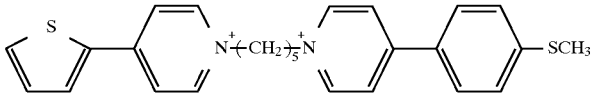
.2Cl⁻

-continued
B-29
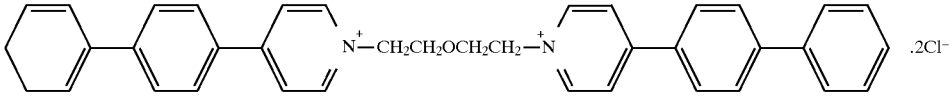
B-30
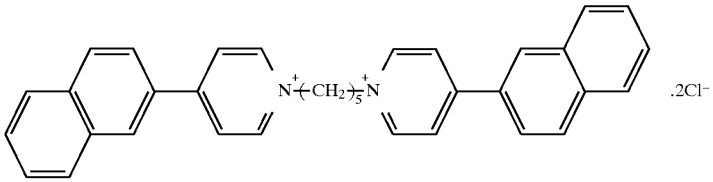
B-31
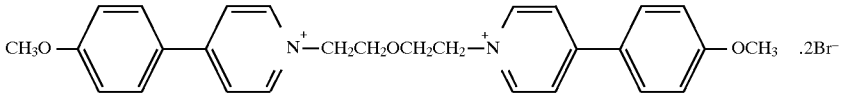
B-32
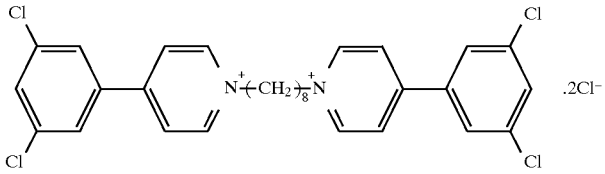
B-33
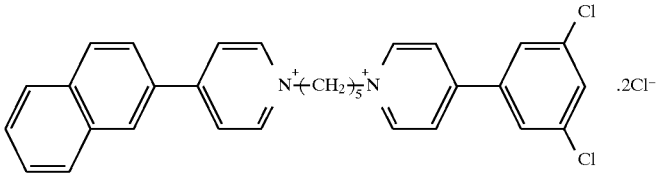
B-34
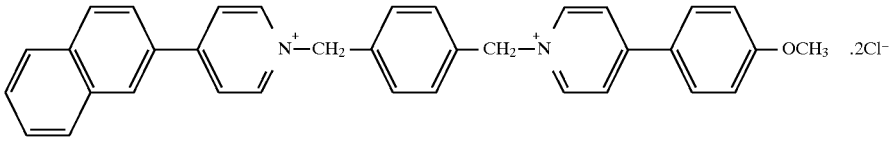
B-35
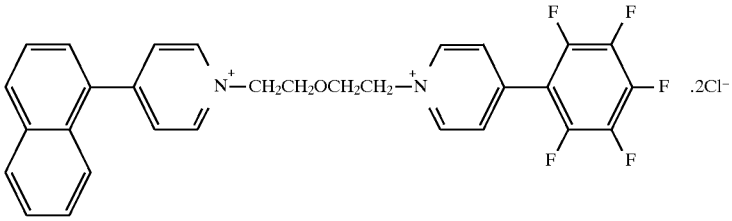
B-36
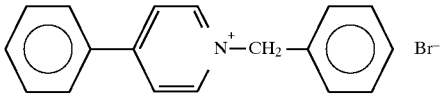
B-37
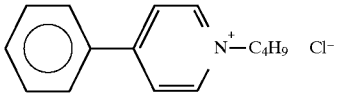
B-38
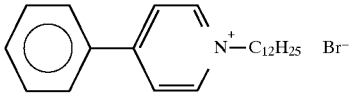
B-39
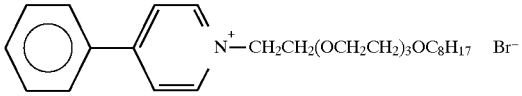

-continued
B-40
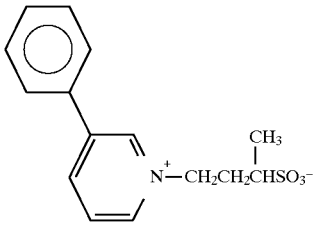
B-41
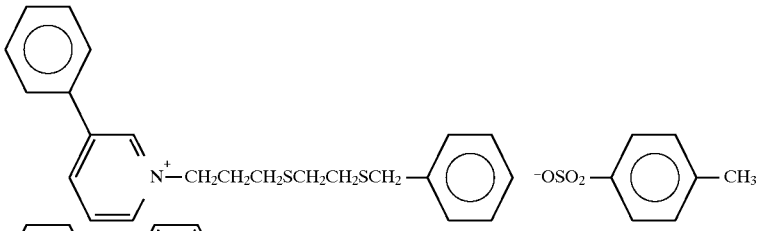
B-42
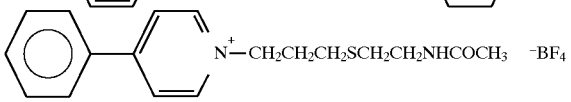
B-43
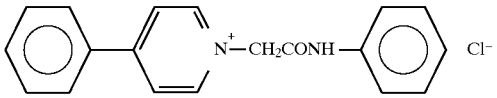
B-44
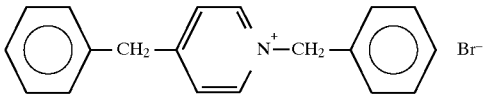
B-45
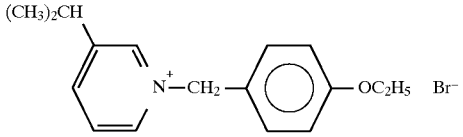
B-46
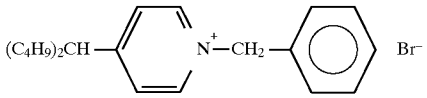
B-47
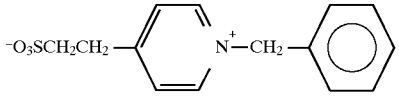
B-48
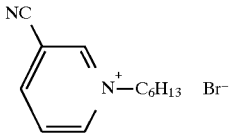
B-49
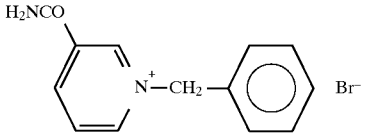
B-50
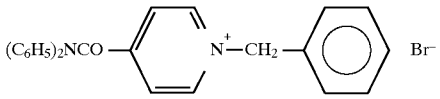
B-51
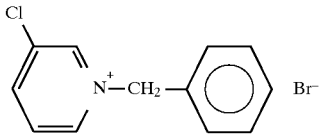

-continued

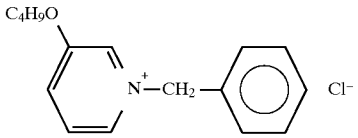

B-52

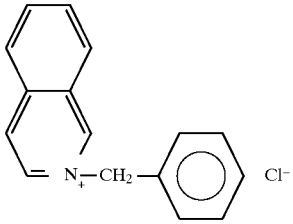

B-53

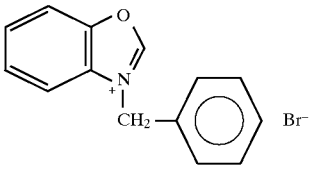

B-54

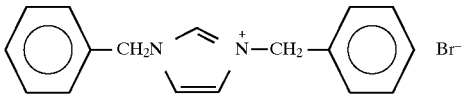

B-55

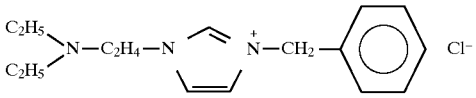

B-56

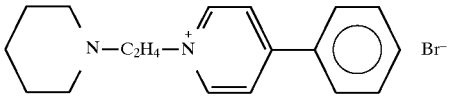

B-57

The addition amount of each compounds represented by formulae (B-1), (B-2) and (B-3) is not particularly limited, but it is preferably from $1\times10^{-5}$ to $5\times10^{-2}$ mol per mol of silver halide, particularly preferably from $2\times10^{-5}$ to $1\times10^{-2}$ mol per mol of silver halide.

The compounds for use in present invention represented by formula (A), (B-1), (B-2) and (B-3) each can be incorporated in a light-sensitive photographic material by adding it to a silver halide emulsion or a hydrophilic colloid solution: in the form of aqueous solution when it is soluble in water; or in the form of solution in a water-miscible organic solvent such as an alcohol (e.g., methanol, ethanol), an ester (e.g., ethyl acetate) or a ketone (e.g., acetone), when it is insoluble in water.

The compounds for use in the present invention may also be used in the form of emulsified dispersion prepared according to a well-known emulsifying dispersion method, wherein the compound is dissolved using an oil (e.g., dibutyl phthalate, tricresyl phosphate, glyceryl triacetate, diethyl phthalate) and an auxiliary solvent (e.g., ethyl acetate, cyclohexanone), and then mechanically emulsified and dispersed. Alternatively, the compounds for use in the present invention may also be used in the form of fine dispersion prepared according to a well-known solid dispersion method.

The direct-positive silver halide for use in the present invention can be fogged using a conventional method after the removal of water-soluble salts which is produced after the formation of a silver halide precipitate. The fogging treatment may be carried out using a fogging agent (reducing agent) alone, or in combination with a gold compound or with another useful metal compound electrically more positive than silver.

Representative examples of fogging agents which is useful for the preparation of a direct-positive emulsion include, e.g., formaldehyde, hydrazine, polyamines (such as triethylenetetramine and tetraethylenepentamine), thiourea dioxide, tetra(hydroxymethyl)phosphonium chloride, amine boran, boron hydride compounds, stannous chloride and stannic chloride; while representative examples of useful metal compounds which is electrically more positive than silver include soluble salts of gold, rhodium, platinum, palladium and iridium, such as potassium chloroaurate, chloroauric acid, ammonium palladium chloride and sodium iridium chloride.

The fogging agent is generally used in an amount of from $1.0\times10^{-6}$ to $1.0\times10^{-1}$ mol per mol of silver-halide.

Representative examples of the gold compound include chloroauric acid, sodium chloroaurate, gold sulfide and gold selenide, and the use amount thereof is generally from $1.0\times10^{-8}$ to $1.0\times10^{-4}$ mol per mol of silver halide.

The degree of fogging of the pre-fogged direct-positive silver halide emulsion for use in the present invention can-be widely changed depending on the intended purpose. The fogging degree, as well known in the arts, depends on not only the halide composition and the grain size of a silver halide emulsion used, but also the kind and the concentration of a fogging agent used, the pH and the pAg of an emulsion to be fogged, the fogging temperature and the fogging time, etc.

In general, when the grain surface is fogged using a fogging agent, the fogging is preferably carried out at a pH of not less than 4.8, at a pAg of not more than 8.0 and at a temperature of not less than 40° C. By adjusting the pH to not more than 4.5 and the pAg to not less than 8.1, a part of the fog nuclei (Ag nuclei) on the grain surface, particularly fine Ag nuclei which are useless because they cannot contribute to Dmax and progress of development, are oxidized to achieve high Dmax, high sensitivity and contrast enhancement at the same time. Further, the oxidation of useless Ag nuclei can lower the Dmin. The time required for the aforementioned bleaching step is at least one minute. The temperature for the bleaching step is not particularly limited. The bleaching proceeds, as the bleaching time is prolonged and the bleaching temperature is increased, so that it is required to appropriately select the bleaching time and temperature to obtain the intended properties.

The lowering of pH in the bleaching step can be effected by using an acid such as acetic acid, hydrochloric acid, phosphoric acids, citric acid, sulfuric acid, malic acid and salicylic acid. In order to heighten the pAg, on the other hand, halides such as a bromide, a chloride and an iodide, and organic compounds capable of combining with Ag ion, such as mercaptotetrazoles, mercaptotriazoles, benzothiazole-2-thiones, benzotriazoles, benzimidazoles, hydroxytetrazaindenes and purines, can be used. Of these compounds, halides are preferred.

At the completion of the bleaching step, it is generally required to raise the pH to 5.0–8.0 and to lower the pAg to 7.8–5.5 for stabilizing Ag nuclei. For the adjustment of pH, alkalis such as sodium hydroxide and potassium hydroxide can be used; while silver nitrate can be used for the adjustment of pAg.

By the adjustment of pH and pAg, requirements for stability as well as photographic properties, including high sensitivity, high Dmax, low Dmin and high contrast, can be fulfilled.

In order to further stabilize the Ag nuclei, formamidinesulfinic acid, hydrazine, a polyamine (e.g., triethylenetetramine, tetraethylenepentamine), formaldehyde, phosphonium chloride, an amineboran compound, a boron hydride compound, stannous chloride, stannic chloride or the like is prefarably added, to the emulsion kept at a temperature of not more than 50° C., preferably not more than 45° C., in an amount of from $10^{-8}$ to $10^{-2}$ mol per mol of Ag, preferably from $10^{-6}$ to $10^{-3}$ mol per mol of Ag.

The silver halide emulsion for use in the present invention may be prepared using any of an acid method, a neutral method and an ammonia method. Examples of the silver halide for use in the present invention include silver bromide, silver chloride., silver chlorobromide, silver iodobromide and silver chloroiodobromide.

Silver halide grains having an average grain diameter of from 0.01 to 2 microns are suitable for use in the present invention. More preferably, the average grain diameter is from 0.02 to 1 micron. The frequency distribution of the grain diameters may be broad or narrow, but preferably narrow. In particular, the silver halide emulsions for use in the present invention is preferably a so-called monodisperse emulsion wherein at least 90%, preferably 95%, in terms of number of the grains have their individual sizes within the range of ±40%, preferably ±20%, of the average grain size. The silver halide grains may have a single crystal habit, or they may be a mixture of grains having different types of crystal habits. However, the grains having a single crystal habit are preferred for the emulsion used in the present invention.

In addition to the ingredients recited above, the direct-positive silver halide emulsion for use in the present invention can contain an inorganic desensitizer (such as noble metal atoms incorporated in the silver halide grains) and an organic desensitizer which is adsorbed to the grain surface of the silver halide, alone or in combination.

The incorporation of the inorganic desensitizer into the silver halide grains can be effected by adding a water-soluble noble metal compound, such as the chloride of a group VIII metal (e.g., iridium, rhodium), in an amount of from $10^{-7}$ to $10^{-2}$ mol, preferably from $10^{-5}$ to $10^{-3}$ mol, per mol of silver halide in the form of aqueous solution during the preparation of the silver halide grains.

The direct-positive silver halide light-sensitive material according to the present invention can further contain various conventional photographic additives. Examples of a stabilizer include triazoles, azaindenes, quaternary benzothiazolium compounds, mercapto compounds and water-soluble inorganic salts of cadmium, cobalt, nickel, manganese, gold, thallium, zinc and the like. To the light-sensitive material for use in the present invention, a hardener such as aldehydes (e.g., formaldehyde, glyoxal and mucochloric acid), s-triazines, epoxy compounds, aziridines and vinylsulfonic acid; a coating aid such as saponin, sodium polyalkylenesulfonates, lauryl- or oleyl-monoether of polyethylene glycol, amylated alkyltaurines and fluorine-containing compounds; and a sensitizer such as polyalkylene oxides and derivatives thereof may be added. Furthermore, the light-sensitive material can contain a color coupler. In addition, a brightening agent, an ultraviolet absorbent, a preservative, a matting agent and antistatic agent can also be added to the light-sensitive material, if desired.

Dyes for use in the present invention generally have their main absorption in the visible wavelength range within the intrinsic sensitive wavelength range of silver halide emulsions which is used for the prevention of irradiation and of the fog generation under safelight. In particular, dyes having their Amax within the range of 350 nm to 600 nm are preferred. The chemical structure of the dye for use in the present invention is not particularly limited. Specific examples of the dye include oxonol dyes, hemioxonol dyes, merocyanine dyes, cyanine dyes and azo dyes. In view of the prevention of color contamination after processing, water-soluble dyes are advantageously used.

More specifically, examples of the dyes which can be advantageously used include, e.g., the pyrazolone dyes described in JP-B-58-12576, the pyrazoloxonol dyes described in U.S. Pat. No. 2,274,782, the diarylazo dyes described in U.S. Pat. No. 2,956,879, the styryl dyes and the butadienyl dyes described in U.S. Pat. Nos. 3,423,207 and 3,384,487, the merocyanine dyes described in U.S. Pat. No. 2,527,583, the merocyanine dyes and the oxonol dyes described in U.S. Pat. Nos. 3,486,897, 3,652,284 and 3,718,472, the enaminohemioxonol dyes described in U.S. Pat. No. 3,976,661, and the dyes described in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

In the present invention, a cyanine dye is preferably used as a desensitizing dye. Useful cyanine dyes are represented by the following formulae (I) to (III):

(I)

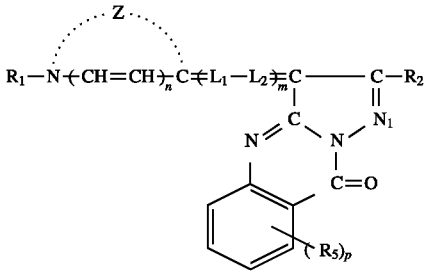

(II)

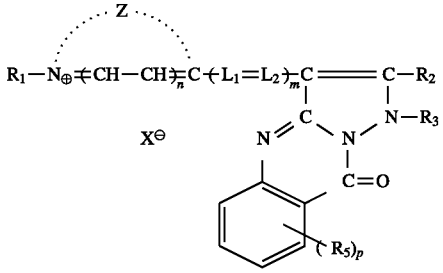

(III)

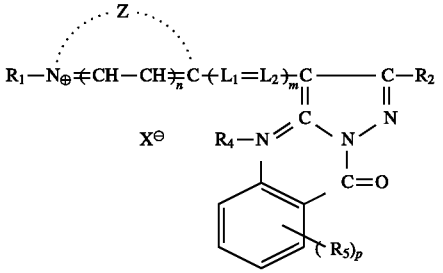

In the above formulae (I), (II) and (III), $R_1$ and $R_3$ each represents an alkyl group, including an unsubstituted alkyl group (e.g., methyl, ethyl, propyl, isopropyl, n-butyl, n-pentyl, n-hexyl) and a substituted alkyl group, such as a hydroxyalkyl group (e.g., β-hydroxyethyl, γ-hydroxypropyl), an acetoxyalkyl group (e.g., β-acetoxyethyl, γ-acetoxy-propyl), an alkoxyalkyl group (e.g., β-methoxyethyl, γ-methoxypropyl), a carboxyalkyl group (e.g., β-carboxyethyl, γ-carboxypropyl, δ-carboxybutyl, ω-carboxypentyl), an alkoxycarbonylalkyl group (e.g., β-methoxycarbonylethyl, γ-ethoxycarbonylpropyl), a sulfoalkyl group (e.g., β-sulfoethyl, γ-sulfopropyl, γ-sulfobutyl, δ-sulfobutyl), an aralkyl group (e.g., benzyl, phenetyl), a sulfoaralkyl group (e.g., p-sulfophenetyl), a carboxyaralkyl group (e.g., p-carboxyphenetyl) or a vinylmethyl group.

$R_2$ represents a hydrogen atom or a group known as a substituent for a pyrazolo[5,1-b]quinazolone compound, such as an alkyl group (e.g., methyl, ethyl, propyl, benzyl), an alkoxy group (e.g., methoxy, ethoxy), a carboxyl group, an alkoxycarbonyl group (e.g., methoxycarbonyl, ethoxycarbonyl), a hydroxyl group or an aryl group (e.g., phenyl, p-methoxy-phenyl).

$R_4$ represents a hydrogen atom, an alkyl group (e.g., methyl, ethyl, propyl), a cycloalkyl group (e.g., cyclohexyl) or an aryl group (e.g., phenyl).

$L_1$ and $L_2$ each represents a methine group, including —CH═and —$CR_6$═ (wherein $R_6$ represents an alkyl group (e.g., a methyl, ethyl or ethoxyethyl group) or an aryl group (e.g., a phenyl group)), and $L_1$ may be linked with $R_1$ via a methylene chain.

Z represents an atomic group necessary for completing a cyanine heterocyclic nucleus.

$R_5$ represents a group known as a substituent for a pyrazolo[5,1-b]quinazolone compound, such as a halogen atom (e.g., fluorine, chlorine, bromine), a lower alkyl group (e.g., methyl, ethyl), an alkoxy group (e.g., methoxy, ethoxy), an aryl group (e.g., phenyl), a carboxyl group, an alkoxycarbonyl group (e.g., methoxycarbonyl), an acylamino group (e.g., acetylamino), an amino group, a nitro group, a phenoxy group, an alkylamino group or a sulfonic acid group.

n represents 0 or 1; m represents 1; and p represents 1, 2, 3 or 4.

Of those cyanine dyes, the compounds represented by formulae (II) and (III) wherein $R_2$ is an alkyl or aryl group and $R_4$ is an alkyl group are particularly preferred.

$X^-$ represents an acid anion, such as chlorine ion, bromine ion, iodine ion, thiocyanate ion, perchlorate ion, p-toluenesulfonate ion, methylsulfate ion or ethylsulfate ion.

Specific examples of the compounds of formulae (I) to (III) are shown below, but these examples are not to be construed as limiting the scope of the invention in any way.

I-(1)

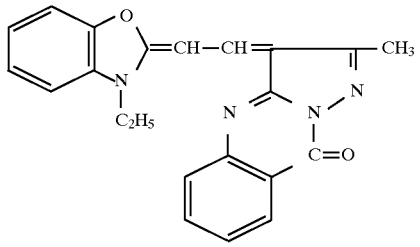

I-(2)

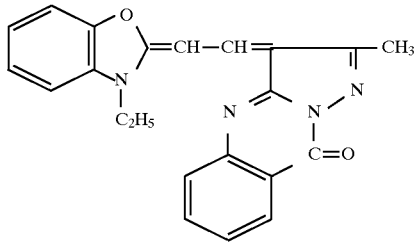

I-(3)

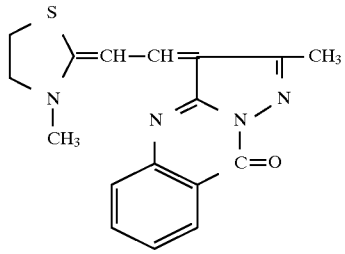

I-(4)

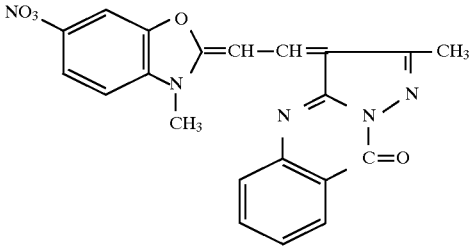

-continued
I-(5)
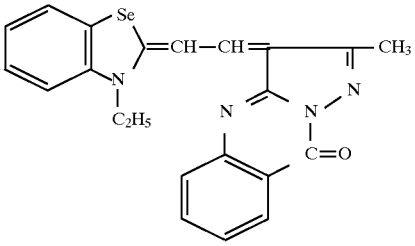
I-(6)
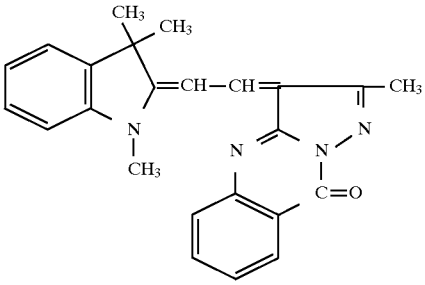
I-(7)
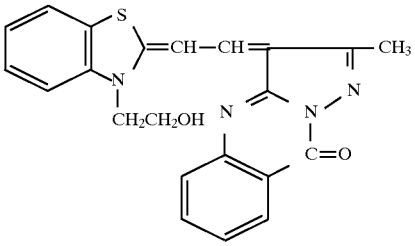
I-(8)
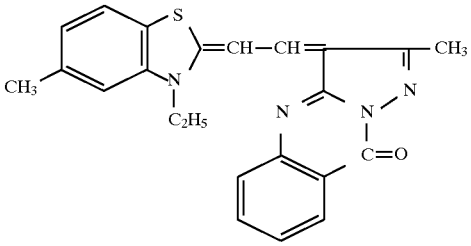
I-(9)
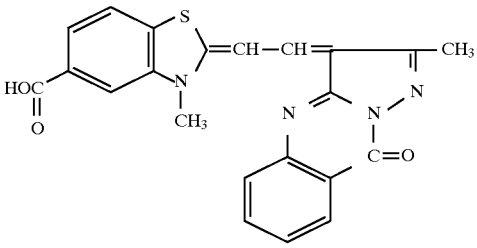
I-(10)
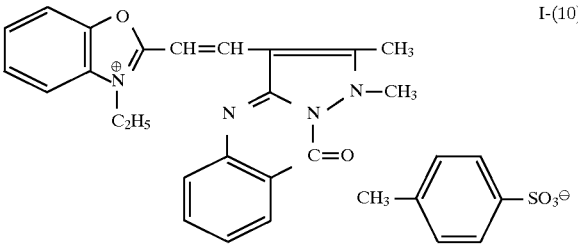
-continued
I-(11)
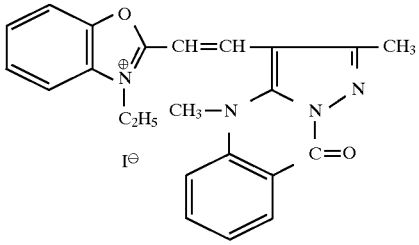
I-(12)
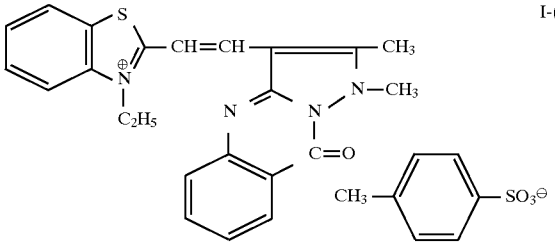
I-(13)
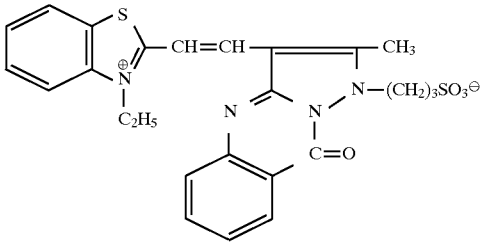
I-(14)
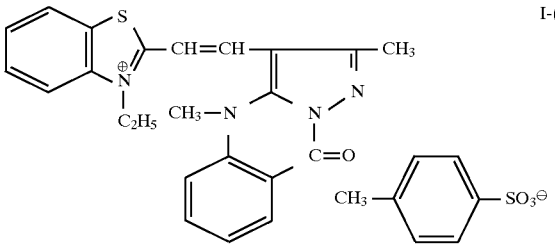
I-(15)
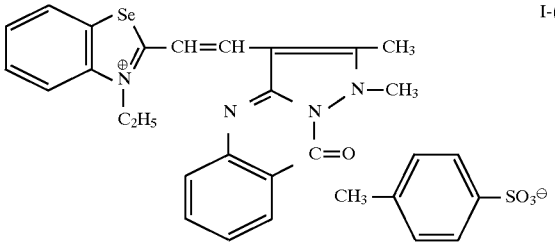
I-(16)
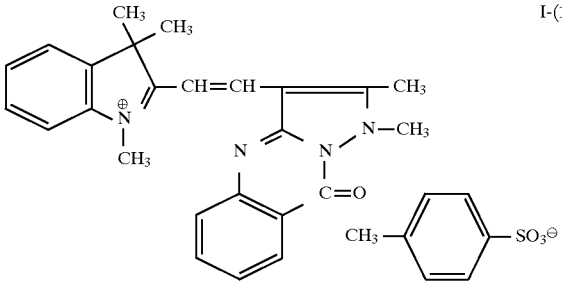

-continued

I-(17)

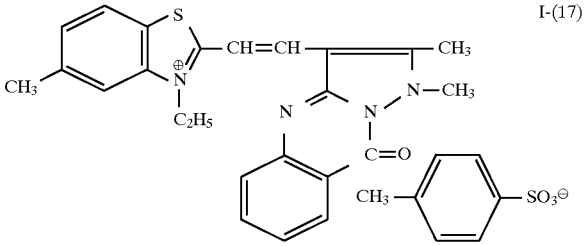

I-(18)

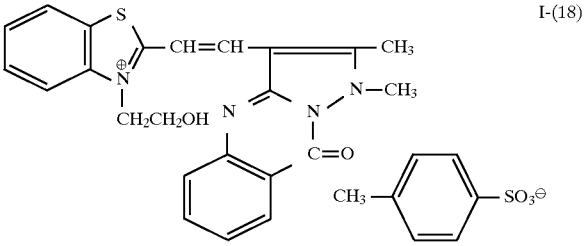

I-(19)

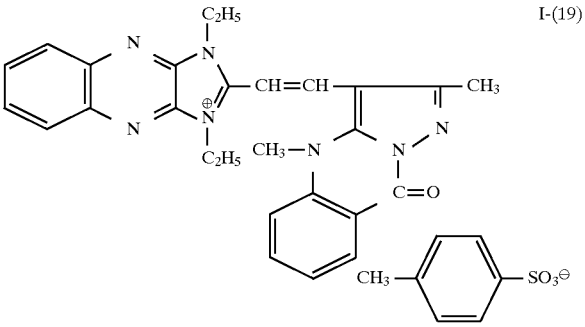

I-(20)

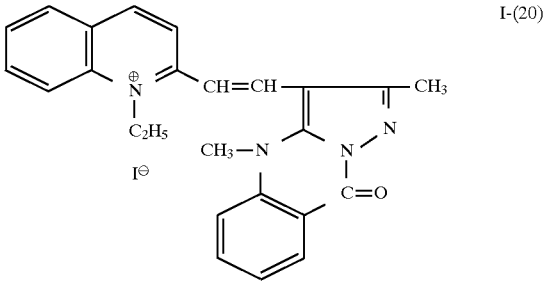

I-(21)

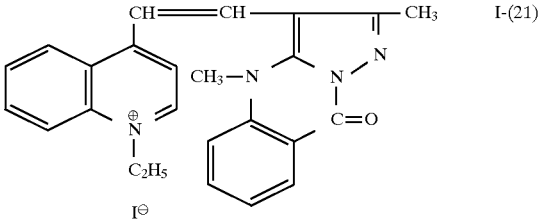

I-(22)

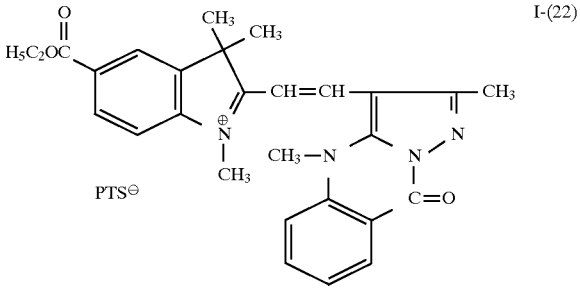

The above described compound is added to the silver halide emulsion layer, and the preferred addition amount thereof is from 50 mg to 2 g per mol of silver halide.

With respect to the objects to be achieved by the present invention, satisfactory results can be obtained by imagewaise-exposing and developing in the presence of compounds containing a sulfur atom capable of bonding with silver ion to be adsorbed on the grain surface of silver halide, such as mercaptotetrazoles, mercaptotriazoles, mercaptothiadiazoles and benzothiazole-2-thiones, and/or compounds containing a nitrogen atom capable of bonding with silver ion to be adsorbed on the grain surface of silver halide, such as benzotriazoles, benzimidazoles, hydroxytetrazaindenes and purines.

Of the above described sulfur-containing restrainers, the compounds having a mercapto group are preferred. More specifically, the compounds represented by the following formula (X) are preferred:

Z-SH (X)

wherein Z represents an aliphatic group (e.g., a substituted alkyl group such as carboxyethyl, hydroxyethyl or diethylaminoethyl), an aromatic group (e.g., phenyl), or a heterocyclic ring residue (preferably a 5- or 6-membered ring residue). The total number of carbon atoms contained in the aliphatic or aromatic group is preferably not more than 18.

Of those groups, the heterocyclic ring residues containing at least one nitrogen atom in their individual rings (the total number of carbon atoms contained therein is preferably not more than 30, more preferably not more than 18) are preferred in particular.

The heterocyclic ring residue represented by Z may be condensed with another ring. Specific examples of such a heterocyclic ring include an imidazole, a triazole, a tetrazole, a thiazole, an oxazole, a selenazole, a benzimidazole, a benzoxazole, a benzothiazole, a thiadiazole, an oxadiazole, a benzoselenazole, a pyrazole, a pyrimidine, a triazine, a pyridine, a naphthothiazole, a naphthimidazole, a naphthoxazole, an azabenzimidazole, a purine and an azaindene (e.g., a triazaindene, a tetrazaindene, pentazaindene).

Furthermore, these heterocyclic ring residues and condensed rings may have an appropriate substituent group.

Specific examples of the substituent group include alkyl groups (e.g., methyl, ethyl, hydroxyethyl, trifluoromethyl, sulfopropyl, dipropylaminoethyl, adamantyl), alkenyl groups (e.g., allyl), aralkyl groups (e.g., benzyl, p-chlorophenetyl), aryl groups (e.g., phenyl, naphthyl, p-carboxyphenyl, 3,5-dicarboxyphenyl, m-sulfophenyl, p-acetamidophenyl, 3-capramidophenyl, p-sulfamoylphenyl, m-hydroxyphenyl, p-nitrophenyl, 3,5-dichlorophenyl, 2-methoxyphenyl), heterocyclic ring residues (e.g., pyridyl), halogen atoms (e.g., chlorine, bromine), a mercapto group, a cyano group, a carboxyl group, a sulfo group, a hydroxy group, a carbamoyl group, a sulfamoyl group, an amino group, a nitro group, alkoxy groups (e.g., methoxy, ethoxy), aryloxy groups (e.g., phenoxy), acyl groups (e.g., acetyl), acylamino groups (e.g., acetylamino, capramido, methylsulfonylamino), substituted amino groups (e.g.,. diethylamino, hydroxyamino), alkyllthio or arylthio groups (e.g., methylthio, carboxyethylthio, sulfobutylthio), alkoxycarbonyl groups (e.g., methoxycarbonyl), and aryloxycarbonyl groups (e.g., phenoxycarbonyl).

In addition, disulfide compounds (Z—S—S—Z) capable of readily splitting off into the form of formula (X) in emulsion may be employed.

Of the sulfur-containing restrainers, those containing a thioketone group are compounds represented by the following formula (XI):

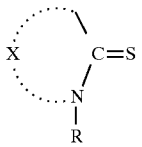

(XI)

wherein R represents an alkyl group, an aralkyl group, an alkenyl group or an aryl group; and X represents an atomic group necessary for completing a 5- or 6-membered ring, which may be condensed with another ring.

Specific examples of a heterocyclic ring completed by X include a thiazoline ring, a thiazolidine ring, a selenazoline ring, an oxazoline ring, an oxazolidine ring, an imidazoline ring, an imidazolidine ring, a thadiazoline ring, an oxadiazoline ring, a triazoline ring, a tetrazoline ring and a pyrimidine ring. Examples of the heterocyclic ring condensed with a carbon ring or another heterocyclic ring include benzothiazoline ring, a naphthothiazoline ring, a tetrahydrobenzothiazoline ring, a benzimidazoline ring and a benzoxazoline ring.

Also, these heterocyclic rings each may have the substituent group(s) exemplified as the substituent for a compound represented by formula (X).

Specific examples of a group represented by R include an alkyl group (such as methyl, propyl, sulfopropyl or hydroxyethyl group), an alkenyl group (such as allyl group), an aralkyl group (such as benzyl group), an aryl group (such as phenyl, p-tolyl or p-chlorophenyl group) and a heterocyclic ring residue (such as pyridyl group).

Typical examples of a compound represented by formula (X) are shown below:

III-1

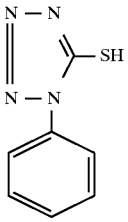

III-2

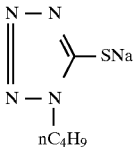

III-3

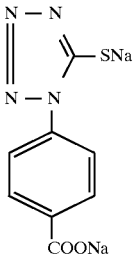

III-4

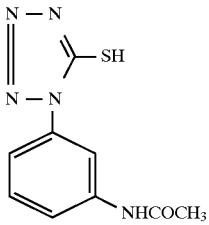

III-5

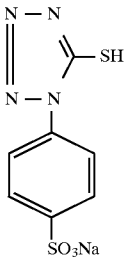

III-6

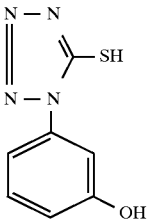

-continued

III-7

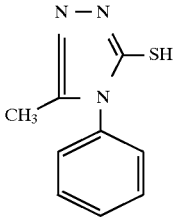

III-8

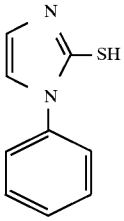

III-9

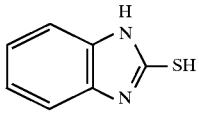

III-10

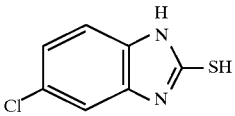

III-11

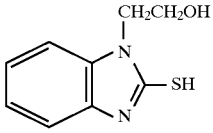

III-12

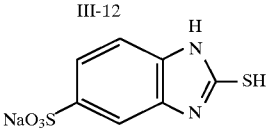

III-13

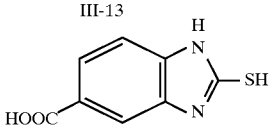

III-14

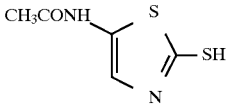

III-15

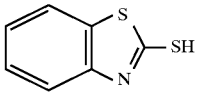

III-16

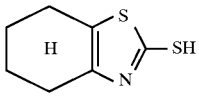

III-17

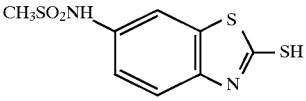

III-18

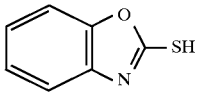

III-19

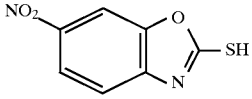

III-20

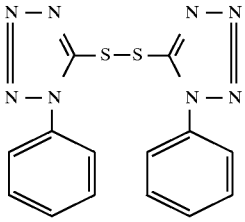

Typical examples of a compound represented by formula (XI) are shown below:

IV-1

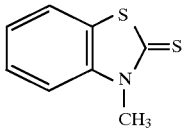

IV-2

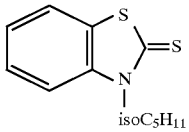

-continued

IV-3

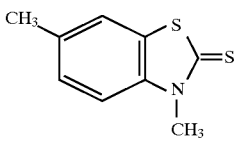

IV-4

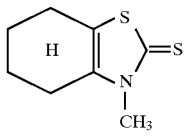

IV-5

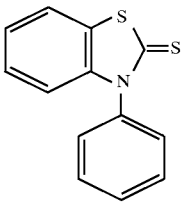

IV-6

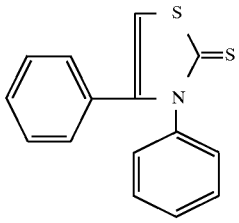

These compounds can be prepared by reference to the literatures cited, e.g., in E. J. Birr, *Stabilization of Photographic Silver Halide Emulsions*, Focal Press (1974); C. G. Barlow et al., *Rer. Prog. Appl. Chem.*, vol. 59, p. 159 (1974); *Research Disclosure,* 17643 (1978); JP-B-48-34169, JP-B-47-18008, JP-B-49-23358; *Kagaku Zasshi (Science Magazine),* 74, 1365–1369 (1954); and Beilstein, XII, 394, IV, 121. The sulfur-containing compound as recited above is added to the silver halide emulsion layer, and the suitable addition amount thereof is from 0.1 to 100 mg/m$^2$, preferably from 0.5 to 50 mg/m$^2$, particularly preferably from 1.0 to 20 mg/m$^2$.

A developing agent for use in the development-processing of the silver halide light-sensitive material of the present invention may be, for example, one or a combination of the organic or inorganic developing agents and auxiliary developing agents described in E. K. Mees & T. H. James, *THE THEORY OF THE PHOTOGRAPHIC PROCESS,* 3rd Ed., pp. 278–381 (1966). Suitable examples of the developing agent include ferrous oxalate, hydroxylamine, N-hydroxymorpholine, hydroquinones (such as hydroquinone, hydroquinone monosulfonate, chlorohydroquinone and t-butylhydroquinone), catechol, resorcinol, pyrogallol, amidol, pyrazolidones (such as phenidone and 4-hydroxymethyl-4-methyl-1-phenyl-3-pyrazolidone), p-aminophenols (such as p-aminophenol, Glycin and Metol), paraphenylenediamines (such as paraphenylenediamine and 4-amino-N-ethyl-N-ethoxyaniline) and ascorbic acid. In particular, Metol alone, a combination of phenidone with Metol, a combination of Metol with hydroquinone, a combination of phenidone, Metol and t-butylhydroquinone, a combination of phenidone with ascorbic acid and a combination of phenidone with p-aminophenol can be advantageously used. Also, other various combinations can achieve good results substantially the same as those obtained by the above described combinations.

The developing solution used for processing the silver halide light-sensitive material of the present invention may contain a developing agent as described above in an amount generally from $1\times10^{-5}$ to 1 mol per liter thereof. In particular, a hydroquinone is preferably used in an amount of at least 20 g/l, more preferably at least 25 g/l. In addition to the developing agent as recited above, the developing solution used for processing the silver halide light-sensitive material can optionally contain: a preservative such as a sulfite or hydroxylamine; various agents for use in a general black-and-white developing solution, examples thereof including a pH modifier and a pH buffer, such as alkali hydroxides, alkali carbonates, alkali borates and amines; an inorganic development inhibitor such as potassium bromide; and an organic development inhibitor, such as benzimidazoles, benzotriazoles and the nitroindazoles described in British Patent 1,376,600.

The direct-positive silver halide light-sensitive material according to the present invention have various uses. For instance, they can be used as: various photographic materials for printing, specifically for duplication, reproduction and offset master uses; special photographic materials, such as an X-ray photographic material, a flash photographic material and an electron-beam photographic material; and various types of direct-positive photographic materials, specifically suitable for general copying, microcopying, direct positive color, quick stabilization, diffusion transfer, color diffusion transfer, combined developing and fixing, etc. These direct-positive silver halide light-sensitive materials provide high contrast, and have markedly improved stability during a long-term storage or under high temperature and high humidity, as compared with conventional ones.

The present invention will be described in more detail by reference to the following Examples, but the invention should not be construed as being limited thereto.

EXAMPLE 1

I. Preparation of Pre-fogged Auto-positive Emulsions for Layer O and Layer U (Emulsions Em-O and Em-U):

To 1,000 ml of a 3% aqueous gelatin solution which was kept at 58° C. and stirred thoroughly, a solution I (1,000 ml of an aqueous solution containing 1 mol of silver halide) and a solution II (an aqueous solution containing KBr and KI in admixture) were added over a 30-minute period while the addition speed of the solution II was being controlled so as to effect a silver potential for cubic grain formation. Thus, a monodisperse cubic AgBrI emulsion having an average grain size of about 0.1 micron, a variation coefficient of about 10% and an iodide content of 1.0 mol % was prepared. This emulsion was washed and desalted according to a conventional flocculation method, admixed with 88 g of a dispersing gelatin and phenoxyethanol as a preservative, and then heated to 40° C. for dissolution. The resultant emulsion was divided into two equal parts, and these parts were each subjected to after-ripening so as to acquire the optimal photographic properties at a pH of 7.00 and at a temperature of 65° C., by adding to each parts the same amount of chloroauric acid ($2.5\times10^{-6}$ mol), the same amount of a desensitizer (Compound 1) ($2\times10^{-4}$ mol), but adding different amount of thiourea dioxide as a fogging agent. Thus, the emulsion for Layer O (Em-O) in which the fogging agent was use in an amount of $2.5\times10^{-6}$ mol, and the emulsion for Layer U (Em-U) in which the fogging agent was used in an amount of $3.5\times10^{-6}$ mol, were prepared. The sensitivity difference between Em-O and Em-U was about 0.3 in terms of Log E value.

II. Production of Coated Samples for Testing:

A sample was prepared using the two emulsions EM-O and Em-U prepared above in accordance with the formulation as shown below. As for the layer structure of the sample, the following Layers 1, 2, 3 and 4 were arranged on the same side of a support in order apart from the support. The conductive layer (Layer 5) and back protecting layer (Layer 6) shown below were coated on the other side of the support.

Formulation of Layer 1 (Emulsion Protecting Layer)

| | |
|---|---|
| Gelatin | 800 mg/m$^2$ |
| Proxel | 1.5 mg/m$^2$ |
| Barium strontium sulfate (average grain size: 1.5 microns) | 27 mg/m$^2$ |
| Liquid paraffin emulsion | 59 mg/m$^2$ |
| Sodium dodecylbenzenesulfonate | 19 mg/m$^2$ |
| Fluorine-containing surfactant (Compound-2) | 4 mg/m$^2$ |
| Surfactant (Compound-3) | 1 mg/m$^2$ |
| Colloidal silica (average grain size: 0.2 micron) | 69 mg/m$^2$ |
| Potassium bromide | 97 mg/m$^2$ |
| EDTA | 14 mg/m$^2$ |
| Acetic acid | 4 mg/m$^2$ |
| Sodium polystyrenesulfonate | 6 mg/m$^2$ |

Formulation of Layer 2 (Emulsion Layer O)

| | |
|---|---|
| Raw emulsion (Em-O), (Ag basis) | 900 mg/m$^2$ |
| Gelatin (contained in the above raw emulsion) | 800 mg/m$^2$ |
| Desensitizing dye (Compound-4) | 11 mg/m$^2$ |
| Acetic acid | 13 mg/m$^2$ |
| Sodium polystyrenesulfonate | 36 mg/m$^2$ |
| 1,3-Divinylsulfonyl-2-propanol | 150 mg/m$^2$ |

Formulation of Layer 3 (Emulsion Layer U)

| | |
|---|---|
| Raw emulsion (Em-U), (Ag basis) | 300 mg/m$^2$ |
| Gelatin (contained in the above raw emulsion) | 260 mg/m$^2$ |
| Desensitizing dye (Compound-4) | 1.8 mg/m$^2$ |
| Acetic acid | 4.4 mg/m$^2$ |
| Sodium polystyrenesulfonate | 12 mg/m$^2$ |

Formulation of Layer 4 (Antihalation Undercoat Layer)

| | |
|---|---|
| Gelatin | 1.8 mg/m$^2$ |
| Proxel | 3.1 mg/m$^2$ |
| Solid dispersion of dye (Compound-5) | 17.3 mg/m$^2$ |
| Solid dispersion of dye (Compound-6) | 83.7 mg/m$^2$ |
| Phosphoric acid | 44 mg/m$^2$ |
| Sodium dodecylbenzenesulfonate | 16 mg/m$^2$ |
| Sodium polystyrenesulfonate | 18 mg/m$^2$ |
| 1,3-Divinylsulfonyl-2-propanol | 79 mg/m$^2$ |

Formulation of Layer 5 (Conductive Layer)

| | |
|---|---|
| Polyacrylate, Julimer ET 410 (trade name, a product of Nippon Junyaku K.K.) | 38 mg/m$^2$ |
| $SnO_2 \cdot Sb$ (9/1 by weight, average grain size: 0.25 micron) | 216 mg/m$^2$ |
| Compound-7 | 5 mg/m$^2$ |
| Compound-8 | 5 mg/m$^2$ |

Formulation of Layer 6 (Back Protecting Layer)

| | |
|---|---|
| Aqueous dispersion of polyolefin, Chemipearl S-120 (trade name, a product of Mitsui Petrochemical Industries, Ltd.) | 33 mg/m$^2$ |
| Compound-7 | 5 mg/m$^2$ |
| Compound-9 | 5 mg/m$^2$ |
| Sodium polystyrenesulfonate | 5 mg/m$^2$ |

III. Preparation of Solid Dispersion of Dye:

The solid dispersion of a dye for use in the present invention was prepared according to the method described in JP-A-63-197943. Specifically, 434 ml of water and 53 g of a 6.7% solution of surfactant, Triton X-200R (trade name, a product of Rhom & Haas Co.) were placed in a 1.5 liter bottle having a screw cap. Thereto, 20 g of a dye and 800 ml of zirconium oxide ($ZrO_2$) beads (diameter: 2 mm) were added, and then the cap was screwed on the bottle. This bottle was put in a mill, and the substances in the bottle was ground into a powder for 4 days. The resultant substances were added to 160 g of a 12.5% aqueous gelatin solution, and allowed to stand for 10 minutes in a roll mill to reduce foams. The thus obtained mixture was filtered to remove the zirconium oxide beads. Since the dispersion thus obtained still contained coarse grains although the average grain size thereof was 0.3 micron, it was further subjected to classification with a centrifugal separator, thereby removing coarse grains so that the maximum dispersed size thereof become not more than 1 micron.

The support used for forming the above described Layers 1 to 4 was a 100 micron-thick polyethylene terephthalate base having the conductive layer (Layer 5) and the back protecting layer (Layer 6) described above on the side opposite to the emulsion-forming side.

The compounds used in the above described formulations are described below;

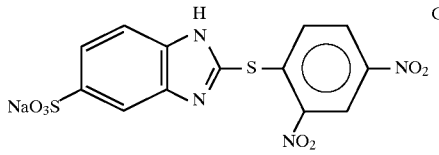
Compound-1

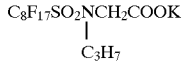
Compound-2

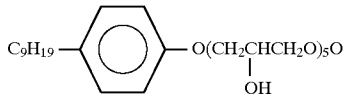
Compound-3

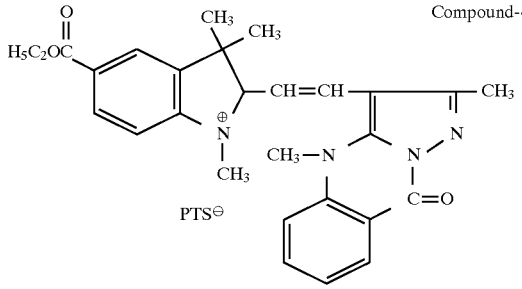
Compound-4

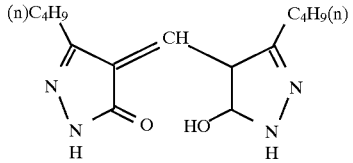
Compound-5

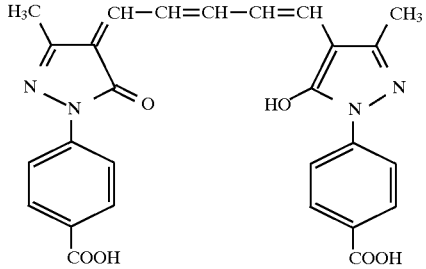
Compound-6

-continued

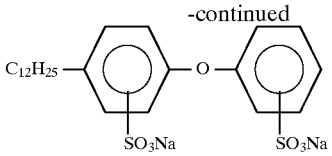

Compound-7

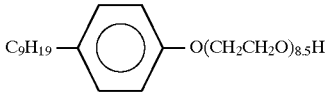

Compound-8

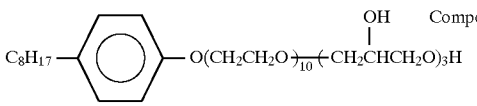

Compound-9

In order to ascertain the effects of the present invention, other coated samples for testing were produced by adding a representative example of the present compounds (Compound B-14) in different amounts (as shown in Table 1). The addition of Compound B-14 was conducted with respect to both the coating solutions for Emulsion Layers O and U in the amounts proportional to the silver contents in EM-O and Em-U respectively, immediately before the coating of the coating solutions.

IV. Evaluation of Photographic Properties:

The photographic properties of each of the thus produced samples were evaluated as follows;

The exposure was carried out using a tungsten sensitometer (color temperature: 2856K) and a step wedge having the density difference of 0.15 under the condition that the illumination was 6,000 lux and the exposure time was 1 second.

The development was carried out at 30° C. for 60 seconds using an automatic developing machine, Auto Processor F-10 (produced by Allen Products Co.). The developer used therein was Kodak Microfilm Developer (1:7 dilution).

The properties evaluated were Dmax, Dmin and $S_{0.2}$ (the sensitivity determined taking the value of (Fog+0.2) as the standard point of the optical density) in terms of shelf life.

To evaluate the shelf life, each sample was allowed to stand for 3 days under the condition of 50° C.-70% RH and then subjected to the above described exposure and development processing.

The evaluation results obtained are shown in Table 1. Additionally, the sensitivity values therein are relative values, with the sample free from Compound B-14 (Sample A-1) being taken as 100.

TABLE 1

Effect of Addition of Compound B-14 to Emulsions before Coating Operation upon Shelf Life of Light-sensitive Material

| Coated Sample | Compound added | Amount added* | Dmax | ΔDmax | Dmin | ΔDmin | $S_{0.2}$ | $\Delta S_{0.2}$ | note |
|---|---|---|---|---|---|---|---|---|---|
| A-1 | B-14 | 0 | 1.90 | −0.32 | 0.05 | +0.02 | 100 | −15 | comparison |
| A-2 | B-14 | 1 | 1.90 | −0.05 | 0.05 | +0.01 | 103 | −2 | invention |
| A-3 | B-14 | 3 | 1.85 | −0.02 | 0.05 | 0 | 105 | 0 | invention |
| A-4 | B-14 | 10 | 1.80 | +0.01 | 0.04 | 0 | 101 | +2 | invention |
| A-5 | B-14 | 30 | 1.75 | −0.01 | 0.04 | 0 | 105 | −5 | invention |
| A-6 | B-14 | 100 | 1.65 | +0.02 | 0.04 | 0 | 110 | −2 | invention |

*: mmol/mol-Ag.

ΔDmax, ΔDmin, $\Delta S_{0.2}$: magnitudes of changes caused by the shelf life test.

As can be seen from Table 1, both Dmax and $S_{0.2}$ changes caused by the forced environmental test were very small in the samples in which Compound B-14 was added, as compared with the comparative sample. That is, the present compound has proved to make a marked improvement in the shelf life of the sensitive material. Furthermore, also when the above described test was conducted by changing Compound A-14 with Compound B-14, similar results were obtained.

EXAMPLE 2

The emulsions corresponding to Em-O and Em-U in Example 1, respectively, were prepared in the same manner as in Example 1, except that before the addition of thiourea dioxide (fogging agent), Compound B-14 was added in an amount as shown in Table 2. Using the emulsions thus prepared, light-sensitive material samples B-1 to B-5 were prepared in the same manner as in Example 1, except that the addition of the Compound B-14 immediately before the coating was omitted, and photographic properties thereof were evaluated in the same manner as in Example 1. The results thereof are shown in Table 2. Additionally, the results therein are represented by relative values, with the sample free from Compound B-14 (Sample B-1) being taken as 100.

TABLE 2

Effect of Compound B-14 added to Raw Emulsion at the time of Fogging

| Coated Sample | Compound added | Amount added* | $S_{0.2}$ | Dmax | Dmin | note |
|---|---|---|---|---|---|---|
| B-1 | B-14 | 0 | 100 | 100 | 100 | comparison |
| B-2 | B-14 | 1 | 105 | 96 | 98 | invention |
| B-3 | B-14 | 3 | 125 | 98 | 96 | invention |
| B-4 | B-14 | 10 | 150 | 95 | 97 | invention |
| B-5 | B-14 | 30 | 180 | 93 | 95 | invention |

*mmol/mol-Ag.

As can be seen from Table 2, the addition of Compound B-14 in the fogging stage of the raw emulsion before the addition of a fogging agent showed a tendency to slightly decrease Dmax and Dmin depending on the amount added, but it brought about a marked increase of the toe sensitivity ($S_{0.2}$). That is, the addition of the present compound has proved to be very effective in enhancement of the sensitivity. In addition to enhancement of sensitivity, a reduction in Dmin could be attained. Furthermore, also when the above described test was conducted by changing Compound A-14 with Compound B-14, similar results were obtained.

EXAMPLE 3

Raw emulsions were prepared in the same manner as in Example 2, except that the addition time of Compound A-12 or Compound B-14 was changed to just before keeping them in a refrigerator, and set in a refrigerator (kept at 8° C.). The set emulsions were taken out from the refrigerator after a one-day or 60-day lapse, and used in the same manner as in Example 2 to prepare light-sensitive materials respectively. The thus prepared samples were each exposed and developed in the same manner as in Example 2 to determine the changes of the maximum density (Dmax) and the sensitivity ($S_{0.2}$) due to the above aging. These values obtained are shown in Table 3 below. Additionally, the results are represented by relative values, with the results of the samples free from the present compound and aged for one day being taken as 100. As can be seen from Table 3, the addition of Compound A-12 and Compound B-14 each to the raw emulsions just before the storage in a refrigerator improved the storage stability of raw emulsions in a refrigerator, without causing marked influences upon the maximum density and the sensitivity.

TABLE 3

Effects of Compound A-12 and Compound B-14 added just before storage in Refrigerator

| | | | Dmax | | $S_{0.2}$ | | |
|---|---|---|---|---|---|---|---|
| Coated Sample | Compound added | Amount added* | 1-day lapse | 60-day lapse | 1-day lapse | 60-day lapse | note |
| C-1 | A-12 | 0 | 100 | 85 | 100 | 115 | comparison |
| C-2 | A-12 | 1 | 100 | 96 | 100 | 102 | invention |
| C-3 | A-12 | 3 | 97 | 96 | 100 | 101 | invention |
| C-4 | A-12 | 10 | 95 | 95 | 100 | 100 | invention |
| C-5 | A-12 | 30 | 90 | 90 | 100 | 95 | invention |
| D-1 | B-14 | 0 | 100 | 85 | 100 | 115 | comparison |
| D-2 | B-14 | 1 | 100 | 95 | 100 | 105 | invention |
| D-3 | B-14 | 3 | 98 | 97 | 100 | 101 | invention |
| D-4 | B-14 | 10 | 94 | 93 | 100 | 100 | invention |
| D-5 | B-14 | 30 | 92 | 92 | 100 | 96 | invention |

While the invention has been described in detail and with reference to specific examples thereof, it will be apparent to one skilled in the art that various changes and modifications can be made therein without departing from the spirit and scope thereof.

What is claimed is:

1. A direct-positive silver halide photographic light-sensitive material which comprises a support having thereon at least one pre-fogged light-sensitive silver halide emulsion layer, wherein the light-sensitive material contains at least one compound represented by the following formula (A), (B-1), (B-2) or (B-3) in the emulsion layer or a hydrophilic protective colloid layer adjacent to the emulsion layer;

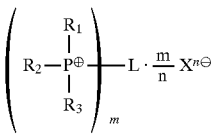

(A)

wherein $R_1$, $R_2$ and $R_3$ each represents an unsubstituted or substituted alkyl, cycloalkyl, aryl, alkenyl, cycloalkenyl or heterocyclic group, m represents an integer, L represents an m-valent organic group which is attached to the P atom via its carbon atom, n represents an integer of 1, 2 or 3, and X is an n-valent anion which may be attached to L;

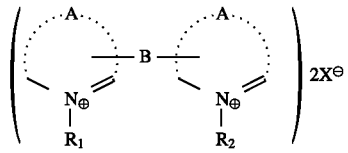

(B-1)

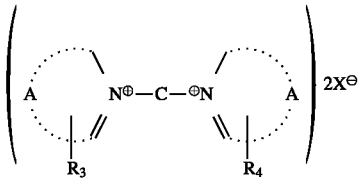

(B-2)

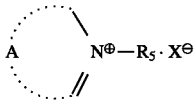

(B-3)

wherein A represents an organic group for completing a heterocyclic ring, B and C each represents a divalent group, $R_1$ and $R_2$ each represents an alkyl group or an aryl group, $R_3$ and $R_4$ each represents a hydrogen atom or a substituent group, $R_5$ represents an alkyl group, and X represents an anion or becomes unnecessary when an inner salt is formed.

2. A method of preparing a pre-fogged direct-positive silver halide emulsion which comprises the steps of:

(a) forming silver halide grains; and (b) thereafter fogging the grain surface of said formed silver halide grains with a reducing agent to produce silver nuclei, wherein at least one compound represented by the following formula (A), (B-1), (B-2) or (B-3) is used:

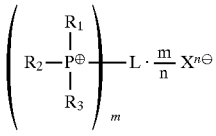

(A)

wherein $R_1$, $R_2$ and $R_3$ each represents an unsubstituted or substituted alkyl, cycloalkyl, aryl, alkenyl, cycloalkenyl or heterocyclic group, m represents an integer, L represents an m-valent organic group which is attached to the P atom via its carbon atom, n represents an integer of 1, 2 or 3, and X is an n-valent anion which may be attached to L;

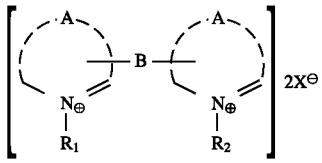

(B-1)

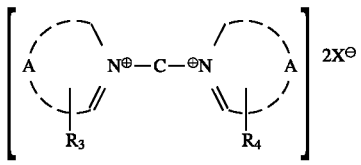

(B-2)

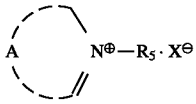

(B-3)

wherein A represents an organic group for completing a heterocyclic ring, B and C each represents a divalent group, $R_1$ and $R_2$ each represents an alkyl group or an aryl group, $R_3$ and $R_4$ each represents a hydrogen atom or a substituent group, $R_5$ represents an alkyl group, and X represents an anion or becomes unnecessary when an inner salt is formed.

3. The preparation method as claimed in claim 2, wherein the fogging is conducted in the presence of the at least one compound represented by formula (A), (B-1), (B-2) or (B-3) to produce silver nuclei.

4. The preparation method as claimed in claim 2, further comprising (c) storing the emulsion in a refrigerator, wherein the at least one compound represented by formula (A), (B-1), (B-2) or (B-3) is added to the emulsion after the fogging and before the storing.

5. The preparation method as claimed in claim 2, wherein the at least one compound represented by formula (A), (B-1), (B-2) or (B-3) is added to the emulsion immediately before coating the emulsion to prepare a silver halide photographic light-sensitive material.

* * * * *